US009516931B2

(12) United States Patent
Mencagli et al.

(10) Patent No.: US 9,516,931 B2
(45) Date of Patent: Dec. 13, 2016

(54) CUSTOMIZABLE ORNAMENT FOR JEWELRY OR COSTUME JEWELRY PRODUCTS

(71) Applicant: Effe Effe Immobiliare S.r.l., Arezzo (IT)

(72) Inventors: Elena Mencagli, Arezzo (IT); Gerard Martin Poubel, Pinerolo (IT)

(73) Assignee: EFFE EFFE IMMOBILIARE S.R.L., Arezzo (IT)

( * ) Notice: Subject to any disclaimer, the term of this patent is extended or adjusted under 35 U.S.C. 154(b) by 160 days.

(21) Appl. No.: 14/401,222

(22) PCT Filed: May 21, 2013

(86) PCT No.: PCT/IB2013/054180
§ 371 (c)(1),
(2) Date: Nov. 14, 2014

(87) PCT Pub. No.: WO2013/175401
PCT Pub. Date: Nov. 28, 2013

(65) Prior Publication Data

US 2015/0082832 A1 Mar. 26, 2015

(30) Foreign Application Priority Data

May 22, 2012 (IT) ..... FI2012U0034

(51) Int. Cl.
*A44C 15/00* (2006.01)
*A44C 17/02* (2006.01)
(Continued)

(52) U.S. Cl.
CPC ..... *A44C 17/0216* (2013.01); *A41D 27/08* (2013.01); *A44B 1/32* (2013.01)

(58) Field of Classification Search
CPC ... A41D 27/08; A44C 17/0216; A44C 25/007; A44C 5/0007; A44C 25/00; A44C 9/0061; A44C 9/00; A44C 1/00; A44C 17/0208; A44B 1/32; Y10T 24/3662
(Continued)

(56) References Cited

U.S. PATENT DOCUMENTS 488,188 A * 12/1892 Drake ..... A41D 27/08 2/244
520,122 A * 5/1894 Rodriguez ..... A44B 1/32 24/109
(Continued)

FOREIGN PATENT DOCUMENTS

CH 701064 11/2010
GB 422634 1/1935
(Continued)

OTHER PUBLICATIONS

International Search Report issued in PCT Application No. PCT/IB2013/054180.

*Primary Examiner* — Jack W Lavinder
(74) *Attorney, Agent, or Firm* — Lucas & Mercanti, LLP

(57) ABSTRACT

The present invention concerns the field of jewelry and costume jewelry, and in particular its object is a customizable ornament that is suitable for forming, or for being incorporated in, a product such as a bracelet, a necklace, a ring, earrings, a pendant or any other similar personal accessory item.

13 Claims, 3 Drawing Sheets

(51) Int. Cl.
*A44B 1/32* (2006.01)
*A41D 27/08* (2006.01)

(58) Field of Classification Search
USPC ..... 63/29.1, 30, 38, 40
See application file for complete search history.

(56) References Cited

U.S. PATENT DOCUMENTS

| | | | | | |
|---|---|---|---|---|---|
| 643,579 | A * | 2/1900 | Wertz, Jr. | A44B 1/32 | 24/109 |
| 700,637 | A * | 5/1902 | Frey | A44C 17/0208 | 63/29.1 |
| 1,034,019 | A * | 7/1912 | Leidig | A44C 17/0208 | 63/29.1 |
| 2,015,559 | A * | 9/1935 | Holm | A44B 1/32 | 24/109 |
| 2,622,291 | A * | 12/1952 | Drell | A44B 1/28 | 24/109 |
| 5,456,095 | A * | 10/1995 | Tawil | A44C 17/0216 | 24/574.1 |
| 2012/0291486 | A1* | 11/2012 | Cardin | A44C 17/0216 | 63/15 |

FOREIGN PATENT DOCUMENTS

| | | |
|---|---|---|
| JP | S5387 | 1/1978 |
| WO | 8902988 | 4/1989 |

* cited by examiner

CUSTOMIZABLE ORNAMENT FOR JEWELRY OR COSTUME JEWELRY PRODUCTS

CROSS-REFERENCE TO RELATED APPLICATIONS

This application is a 371 of PCT/IB2013/054180, filed May 21, 2013, which claims the benefit of Italian Patent Application No. FI2012U000034, filed May 22, 2012, the contents of each of which are incorporated herein by reference.

TECHNICAL FIELD OF THE INVENTION

The present invention concerns the field of jewelry and costume jewelry, and in particular its object is a customizable ornament that is suitable for forming, or for being incorporated in, a product such as a bracelet, a necklace, a ring, earrings, a pendant or any other similar type of personal accessory item. The customization should be intended with reference to both the possibility of the user of "creating" the appearance of his own accessory item in the point of sale at the moment of purchase selecting from various solutions available, and modifying the appearance of a product that has already been purchased by replacing parts that are sold separately as spare parts.

BACKGROUND OF THE INVENTION

As it is known, for accessories of this kind, customization is very strongly requested by the customers and push retailers and consequently the manufacturers to research solutions that allow such requirement to be satisfied in the most functional and practical manner possible, with a high quality result in terms of its appearance.

Among the solutions proposed in this field, some that have recently gained favour are those in which a replaceable decorative insert, in the form of a disc-shaped plate or in any case in a different shape, is fixed in a reversible manner to a base through magnetic or snap-fitting means which, because of their simplicity, make it possible for the user himself to assemble or disassemble it.

Indeed, it is the disassembling that leads to quite a serious technical problem, due to the fact that the reversible fixing system of the insert at the base must on one hand be, as mentioned, easily reversible, but at the same time it must ensure high secureness (so as to minimise the risk of the insert being accidentally lost or removed). These are requirements that are in some way opposite to one another, and that known solutions have not been able to combine in a completely satisfactory manner.

In fact, since it is necessary to assign a priority to the security requirements, disassembling methods are proposed that are not suitably simple and intuitive, requiring acting upon the rear area of the base (i.e. that opposite to the front area on which the insert is exposed), which is not always very accessible, said actions sometimes requiring a certain amount of skill, or effort, or the use of special accessory tools, with small dimensions, that are not easy to handle and that can be easily lost.

SUMMARY OF THE INVENTION

The present invention, on the other hand, proposes a customizable ornament that is capable of overcoming such problems, thanks to a system for fixing the base to the insert that is simultaneously secure and easily reversible, without requiring difficult manoeuvres (especially on the rear side of the base), or accessory tools. This with a structure that is in any case elementary and cost-effective providing a result in terms of its appearance that is elegant and particularly appreciable.

According to the present invention, an ornament comprises the essential characteristics according to the independent attached claim 1. Other important characteristics are defined by the dependent claims.

BRIEF DESCRIPTION OF THE DRAWINGS

The characteristics and the advantages of the ornament according to the invention shall become clearer from the following description of an embodiment thereof, given as an example and not for limiting purposes with reference to the attached drawings, in which.

DETAILED DESCRIPTION OF THE INVENTION

Figure 1:
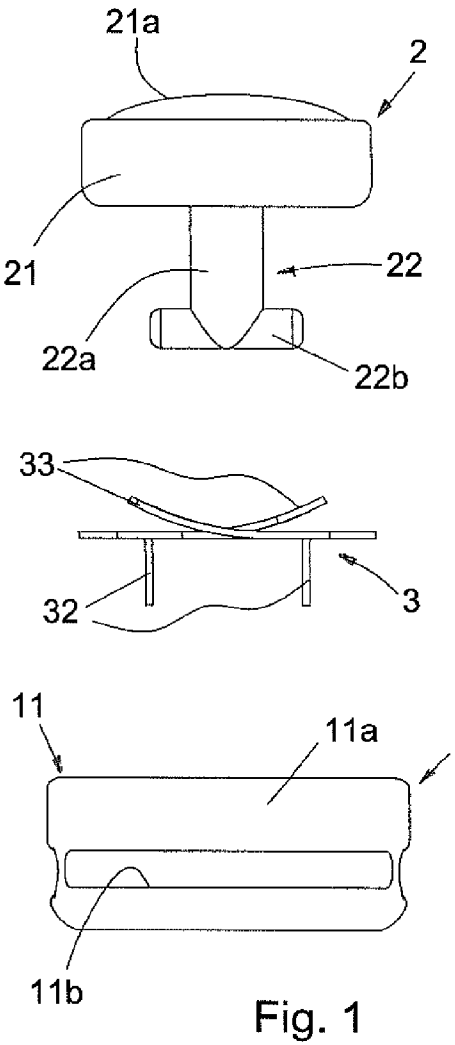
FIG. 1 shows an exploded side view of the ornament according to the present invention.

With reference to the above figures, an ornament according to the invention comprises a base 1, in the example having an overall cylindrical shape, the periphery of which is defined by a ring-like belt 11 developing symmetrically around a central axis X. A flat diaphragm 12 extends inside the belt 11 perpendicular to the axis X and, in cooperation with the belt itself, it forms two concavities, a front concavity or seat 13 and a rear concavity 14, respectively. The outer surface 11*a* of the belt 11 has two circumferential grooves 11*b*, for example that develop according to two opposite arcs in the area of the belt corresponding to the rear concavity 14.

Figure 2:
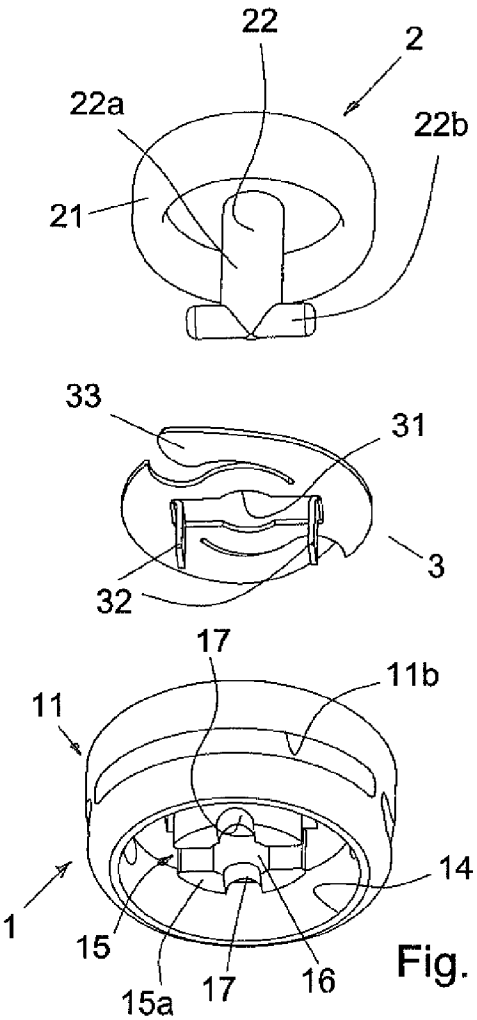
FIGS. 2 and 3 show the same exploded view in axonometric views from a point of view that is shifted towards the rear side and towards the front side of the ornament, respectively.
Figure 3:
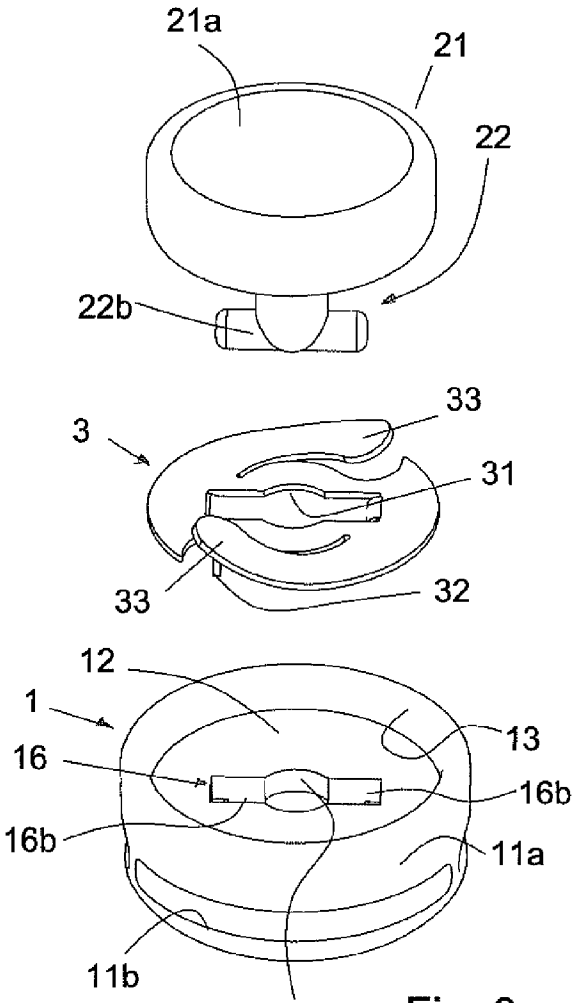

An axial protrusion 15 projects from the diaphragm 12 centrally inside the rear concavity 14, said protrusion being centrally hollow due to a passage 16 opening, at one end, onto the same diaphragm and, at the opposite end, on a free end 15*a* of the protrusion 15. The section of the passage 16 is elongated according to a diametrical axis, with a central portion 16*a* which, enlarged with respect to the thickness (crosswise dimension) of end portions 16*b*, takes up a substantially cylindrical configuration. The free end 15*a* of the protrusion 15 moreover has a pair of recesses 17, diametrically aligned along a direction that is perpendicular with respect to the diameter along which the hollow corresponding to the section of the passage 16 (see in particular FIG. 2) runs.

The front concavity or seat 13 is intended to fittingly house an insert 2 that is substantially mushroom-shaped, comprising more precisely a head 21, a front face 21*a* of which, variously decorated or in any case customized, flat or in relief, remains exposed and represents the characterising aesthetic element of the ornament. From the head 21, on the side opposite with respect to the front face 21*a*, a key shaped stem 22 projects, specifically in the shape of a T in the example, having an axial shaft 22*a* and a cross piece 22*b* at the free end.

The stem 22 is suitable for penetrating the passage 16 of the base 1, with the shaft 22*a* taking up the central portion 16*a* and the cross piece 22*b* inserting in the end portions 16*b*. The axial extension of the stem 22 is moreover such that, when the head 21 abuts against the diaphragm 12, the cross piece 22*b* comes out from the passage 16, beyond the free end 15*a* of the protrusion 15 inside the rear concavity 14. In such a configuration the insert can be freely rotated around the axis X; more precisely the central cylindrical portion 16*a* of the passage 16 guides the rotation of the shaft 22*a*, with the cross piece 22*b* that can thus be arranged at the recesses 17 (this will be further considered in greater detail hereafter)

Between the insert 2, or more precisely the head 21, and the base 1, or more precisely the diaphragm 12, according to the invention there are further provided elastic means 3, which are suitable for opposing the displacement of the head 21 towards the diaphragm 12, and consequently for urging the same head towards the front side. Such elastic means preferably take up the configuration of a laminar disc 3, suitably shaped in accordance with the perimeter of the front seat 13, placed over and in contact with the diaphragm 12. The disc 3 has a central window 31 with an elongated shape that is congruent with that of the passage 16 of the base 1, and a pair of tabs 32 extending from respective ends of the window 31 on the rear side or face. Such tabs 32 are suitable for being folded so as to hook onto the diaphragm 12, indeed on the rear side inside the rear concavity 14, acting as elements for anchoring the disc to the base 1.

Two leaf portions 33 are raised from the plane of the disc 3 and constitute the elastically active component, since they react elastically to a bending that, caused by a force directed axially from the front side (just like that which is exerted by the head 21 of the insert 2 when it is inserted inside the seat 13), tends to move them closer to the diaphragm 12. Advantageously, the laminar portions 33 are two circular segments that evolve peripherally along arcs that are diametrically opposite to one another, simply defined by shaped cuts that leave the portions fixedly attached with one end to the rest of the disc, and free at the opposite end which reaches the position that is the most raised from the plane of the same disc. Again preferably, the two portions 33 are symmetrical to one another, in the sense that the (raised) free ends of the portions are aligned along one same diameter, the same applying to the ends attached to the disc.

Figure 4A:
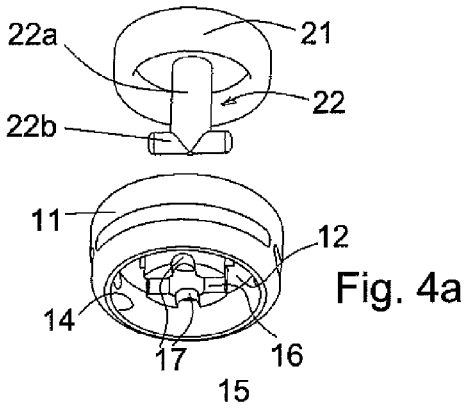
FIGS. 4*a* to 4*d*, and 5*a* to 5*d* represent various subsequent steps of the procedure for assembling the ornament, through axonometric views that are analogous to and correspond to those of FIGS. 2 and 3, respectively.
Figure 5A:
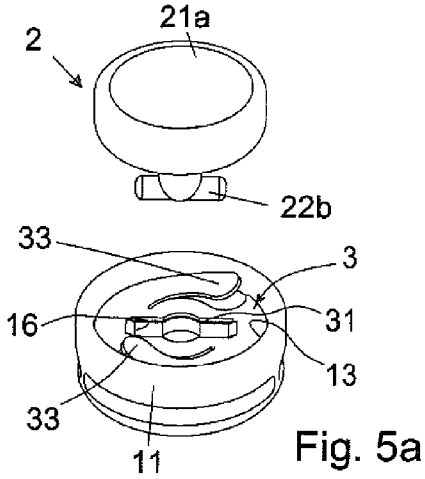
Figure 4B:
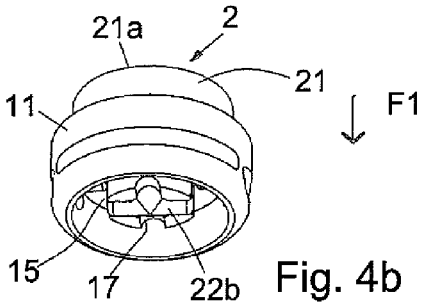
Figure 5B:
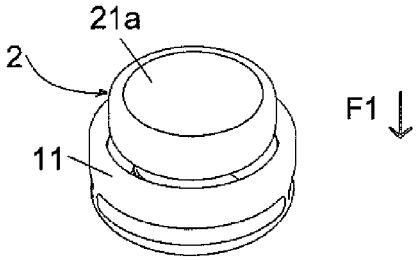

With particular reference to figures from 4*a* to 4*d*, the procedure for connecting the insert 2 to the base 1 is carried out manually as follows (the spring 3 being previously anchored to the base 1 like what has just been described). The passage 16 of the base 1 is penetrated by the stem 22 of the insert 2 (FIGS. 4*a*, 5*a*), until the head 21 comes into contact with the raised ends of the portions 33 (FIGS. 4*b*, 5*b*). At this stage, in order to continue the run of the head 21 towards the diaphragm 12 it is necessary to lightly force it (arrow F1), so as to overcome the elastic resistance of the portions 33.

Figure 4C:
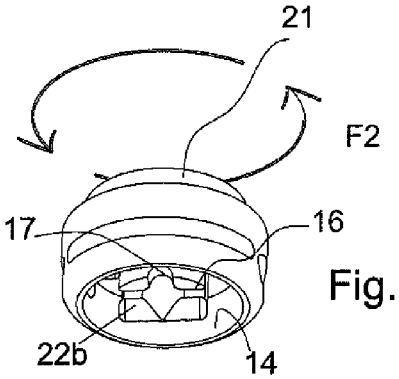
Figure 5C:
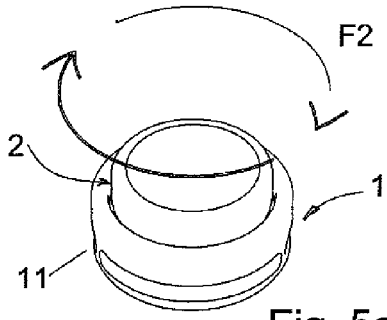
Figure 4D:
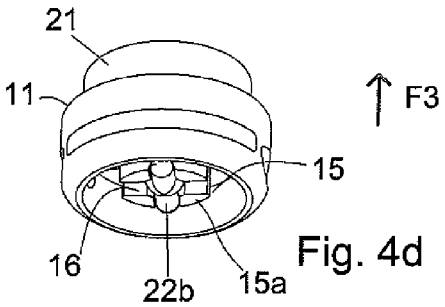
Figure 5D:
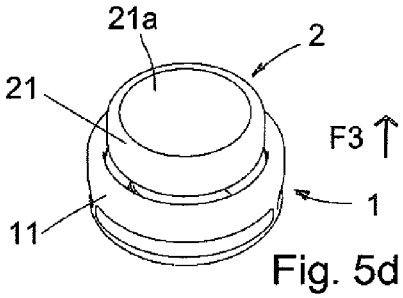

When such an end stop is finally reached (FIGS. 4*c*, 5*c*) the cross piece 22*b* comes out from the passage 16 and it is possible to give the insert a rotation (to that moment prevented by the abutment of the same cross piece itself against the inner walls of the passage 16), like the arrows F2, so as to bring the cross piece, with an angular displacement of 90°, to the recesses 17. By finally releasing the insert, the action of the elastic portions 33 again pushes the head 21 upwards, and consequently makes the cross piece 22*b* snap-fit inside the recesses 17, suitably sized so as to house the ends thereof (FIGS. 4*d*, 5*d*, arrow F3).

In such a condition, corresponding to the final configuration, or configuration of use of the ornament, the insert is fixedly locked in position by the abutment of the cross piece against the free end 15*a* of the protrusion 15, urged by the elastic portions 33. Only an axial pressure exerted from the front side on the outside of the head 21 can free the cross piece again from the engagement with the recesses 17, overcoming the elastic resistance of the portions 33, and thus making it possible, after another 90° rotation (reversed or consecutive to the previous one), to re-establish the conditions for making the stem 22 come out from the passage 16 of the base 1. In such a way the insert 2 can be removed so as to be replaced with a differently decorated insert, by again following the assembly procedure described above.

Thanks to the particular configuration of the elastic means 33, together with a suitable selection of material used (typically but not necessary metal) for its rigidity characteristics, it is possible to calibrate the elastic hindering force exerted, so as to reach an optimal compromise between the requirements of secureness and those of relative simplicity of the assemble/disassembly steps. Indeed, it is possible to make the axial force necessary for the release fairly high so as to prevent, or in any case minimize, the risk of an undesired release, without however exceeding a threshold that would make the release too difficult to carry out when removing/replacing the insert.

Also the particular configuration of the engagement of the stem with the protrusion of the base decisively collaborates in reaching such a compromise. Thanks to such a configuration the movement that leads to the release is a composite movement (pressure and rotation), therefore an adequate degree of security is ensured even when a low release pressure is set, since it is highly improbable for an accidental, involuntary or fraudulent action to be able to exert an axial pressure and at the same time the necessary rotation.

One material that can be used for the spring 3 is for example copper alloys (for example Cu—Be alloys), spring steel, but other metal or non-metal materials with a suitable rigidity can be used. For the rest of the ornament the reference materials can be those typically used in the field, or rather, materials that are precious, semi-precious or not precious for the base and for the body of the insert, with stones that are precious or semi-precious, enamels, glass, resins or anything else for creating the decoration of the front face 21*a* of the head 21. The term decoration must, furthermore, be taken broadly speaking, being it possible for functional elements such as a watch case, a compass or anything else to be included.

Figure 6:
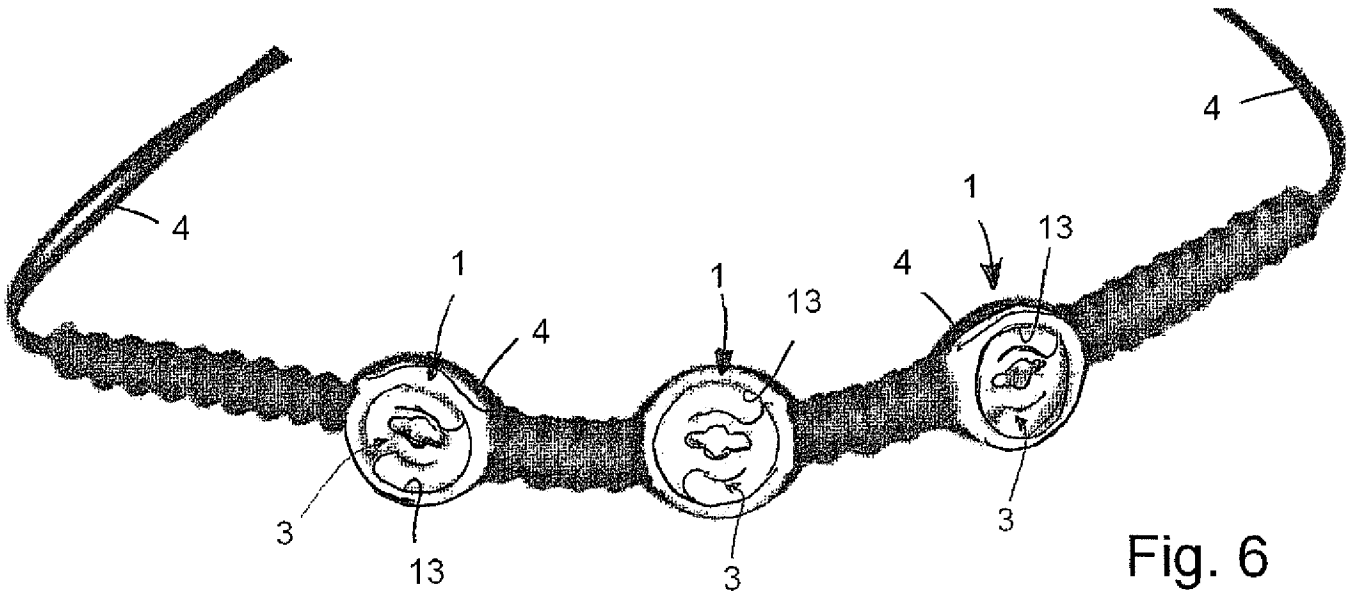
FIG. 6 is a perspective view of an example of a bracelet obtained with a plurality of ornaments according to the previous figures, represented without the respective inserts.

With reference to FIG. 6, the ornament according to the invention can be for example integrated in a bracelet, and for such a purpose the outer grooves 11*b* of the belt 11 can be used for the engagement of a lace 4 that forms the core of the bracelet and that, through known and per se obvious knotting techniques, connects in series a plurality of ornaments to one another the customization designs of which can also be selected so as to obtain a conceptual association or simply be combined according to a coherence of style. Of course, other types of jewels such as earrings, pendants, chokers, necklaces in general, rings can be made with the present ornament, alone or in series, integrating it or integrating them as desired with the base structure of the jewel with any suitable method, selected among those known.

From this last point of view, it should be noted that the solution according to the invention is such as to not require—for the assembly and disassembly operations—acting upon the rear part, therefore, when enclosing the ornament itself in a complex product there is maximum construction freedom, with embodiments that can also foresee making the aforementioned rear part inaccessible. The ornament can therefore, for example, be welded or in any case fixed on to the outer face of a bracelet with a metal plate, however other applications on belts, bags or other similar personal accessories are not excluded.

The ornament according to the present invention ultimately achieves a secure and functional solution, which does not require particular strength, or skill, or tools, is cost-effective to make and does not have any negative effect on the appearance.

Of course, the outline of the head of the insert and correspondingly of the base, just like the configuration of the elastic means and in general the strictly constructive provisions may vary with respect to the advantageous ones of the embodiment described and illustrated here. The invention is not indeed limited to such a preferred embodiment, and other embodiments are possible belonging to the same inventive concept, all covered by the scope of protection of the following claims.

The invention claimed is:

1. An ornament comprising: a base with a peripheral belt developing in a ring shape around a central axis (X), a diaphragm located inside said belt delimits a front seat, and a passage formed centrally on said diaphragm; an insert reversibly connected to said base, comprising a head adapted to be housed inside said front seat displaying a front face thereof provided with a decoration and a stem projecting from the head and comprising locking means to be inserted inside said passage and rotated around said axis (X) so as to establish a lock against the extraction of the insert following a mechanical abutment between the stem and said diaphragm; and elastic means arranged on said diaphragm inside said front seat, suitable for elastically urging said head in a direction opposite to that of insertion of said stem inside said passage.

2. The ornament according to claim 1, wherein said locking means comprise a cross piece that extends so as to form a T-shape from one free end of a shaft adapted to extend along said axis.

3. The ornament according to claim 2, wherein said passage has a section that is elongated according to a diametrical axis, with an enlarged cylindrical central portion adapted to receive said shaft, and end portions adapted to receive said cross piece.

4. The ornament according to claim 2, wherein said diaphragm defines, on the side opposite to said front seat, a rear concavity inside which a protrusion axially projects, a free end of which has means for engaging said cross piece in the rotated locking configuration, the axial extension of said protrusion being such as to allow the free rotation of said stem when said head abuts against said diaphragm, said engagement means being engaged due to the axial abutment of said cross piece urged by said elastic means.

5. The ornament according to claim 4, wherein said engagement means comprise a pair of recesses formed in said free end of the protrusion, diametrically aligned along a direction that is substantially perpendicular with respect to the diameter along which the section of said passage extends.

6. The ornament according to claim 1, wherein said elastic means comprise a laminar disc matchingly shaped with the perimeter of said front seat placed over and in contact with said diaphragm, said disc having a central window with a shape substantially congruent with the section of said passage, means for anchoring the disc to said base and at least one leaf portion raised with respect to the plane of the disc and suitable for reacting elastically to the bending caused by a force in the axial direction.

7. The ornament according to claim 6, wherein said laminar disc comprises two raised leaf portions, configured as respective circular segments that extend peripherally along diametrically opposite arcs, defined with shaped cuts that leave the portions themselves fixedly attached with one end to the rest of the disc, and free at the opposite end reaching a position that is the most raised from the plane of the same disc.

8. The ornament according to claim 7, wherein said two portions are symmetrical to one another, the free ends of the portions being aligned along a same diameter, the same applying to the ends attached to the disc.

9. The ornament according to claim 6, wherein said anchoring means comprise a pair of tabs extending from respective ends of said window and adapted to be folded to hook onto said diaphragm.

10. The ornament according to claim 1, wherein an outer surface of said ring-like belt comprises connection means of the ornament adapted to be used to embody the same ornament in a jewel or other clothing accessory.

11. The ornament according to claim 10, wherein said connection means comprise two circumferential grooves that develop according to two diametrically opposite arcs.

12. A jewel or other clothing accessory comprising at least one ornament according to claim 1.

13. A kit comprising a jewel according to claim 12, and at least one replacement additional head with a front face with a different decoration, customization or the like.

* * * * *